US009984652B2

(12) United States Patent
Kambhatla

(10) Patent No.: US 9,984,652 B2
(45) Date of Patent: May 29, 2018

(54) TOPOLOGY AND BANDWIDTH MANAGEMENT FOR IO AND INBOUND AV

(71) Applicant: Intel Corporation, Santa Clara, CA (US)

(72) Inventor: Srikanth Kambhatla, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 340 days.

(21) Appl. No.: 14/225,783

(22) Filed: Mar. 26, 2014

(65) Prior Publication Data

US 2015/0054755 A1 Feb. 26, 2015

Related U.S. Application Data

(60) Provisional application No. 61/868,682, filed on Aug. 22, 2013, provisional application No. 61/879,253, filed on Sep. 18, 2013.

(51) Int. Cl.
*G09G 5/00* (2006.01)

(52) U.S. Cl.
CPC ..... *G09G 5/006* (2013.01); *G09G 2370/04* (2013.01); *G09G 2370/10* (2013.01)

(58) Field of Classification Search
CPC .... G09G 5/12; G09G 5/006; H04N 21/43615; H04N 5/775
USPC ..... 345/173
See application file for complete search history.

(56) References Cited

U.S. PATENT DOCUMENTS

| | | | | |
|---|---|---|---|---|
| 2003/0071799 | A1 | 4/2003 | Myers | |
| 2006/0248570 | A1* | 11/2006 | Witwer | 725/135 |
| 2008/0187028 | A1 | 8/2008 | Lida | |
| 2010/0185792 | A1 | 7/2010 | Yao | |
| 2010/0293287 | A1* | 11/2010 | Kobayashi | 709/231 |
| 2011/0004704 | A1* | 1/2011 | Herlein et al. | 710/5 |
| 2011/0182560 | A1 | 7/2011 | Kambhatla | |
| 2011/0243035 | A1 | 10/2011 | Hall et al. | |
| 2012/0063376 | A1* | 3/2012 | Kambhatla et al. | 370/310 |
| 2013/0080665 | A1* | 3/2013 | Park | G06F 13/14 710/60 |
| 2014/0115192 | A1 | 4/2014 | Hunkins et al. | |

FOREIGN PATENT DOCUMENTS

| | | | |
|---|---|---|---|
| CN | 1414488 | A | 4/2003 |
| CN | 101888514.3 | A | 11/2010 |

(Continued)

OTHER PUBLICATIONS

Chinese Office Action in corresponding CN application No. 201410416303.1 dated Dec. 1, 2016.

(Continued)

*Primary Examiner* — Gustavo Polo
(74) *Attorney, Agent, or Firm* — Trop Pruner & Hu, P.C.

(57) ABSTRACT

DisplayPort topology may be managed in the presence of sink devices that can stream audio/visual (AV) content to the source device, or can receive or transmit IO information from/to the source device. This IO information may include raw sensor data for a touch screen, for example. The framework could be used to support/map other published IO interface standards, over DisplayPort interface. A high bandwidth receive path can be configured in the topology independent of the transmit path to support inbound IO and AV functions.

30 Claims, 5 Drawing Sheets

(56) References Cited

FOREIGN PATENT DOCUMENTS

| | | | |
|---|---|---|---|
| CN | 101888514 | A | 11/2010 |
| CN | 101971153 | A | 2/2011 |
| JP | 2000069035 | A | 3/2000 |
| JP | 2009015569 | A | 1/2009 |
| JP | 2011517170 | A | 5/2011 |
| JP | 2012093926 | A | 5/2012 |
| TW | I353152 | A | 3/2008 |
| TW | I353152 | | 11/2011 |

OTHER PUBLICATIONS

German Office Action in corresponding DE application No. 102014111457.4 dated Jun. 27, 2016.

German Office Action in corresponding DE application No. 102014111457.4 dated Nov. 18, 2016.

Great Britain Office Action in corresponding GB application No. 1414976.9 dated Feb. 23, 2015.

Korean Office Action in corresponding KR application No. 10-2014-0107601 dated Jul. 21, 2015.

Korean Final Rejection in corresponding KR application No. 10-2014-0107601 dated Feb. 29, 2016.

Korean Office Action in corresponding KR application No. 10-2014-0107601 dated Jun. 20, 2016.

Great Britain Office Action in corresponding GB application No. GB1414976.9 dated Oct. 2, 2017 (4 pages).

Japanese Patent Office, Japanese Office Action issued in corresponding Application No. 2014-156171 dated Aug. 4, 2015 (10 pages) [w/English translation].

Taiwan Patent Office, Taiwan Office Action in corresponding TW103128457 dated Aug. 20, 2015 (8 pages) [w/English translation].

Taiwan IPO Search Report in corresponding TW103128457 dated Aug. 20, 2015 (3 pages) [w/English translation].

German Office Action in corresponding DE application No. 102014111457.4 dated May 3, 2017 (4 pages) [no English translation].

Chinese Office Action in corresponding CN application No. 201410416303.1 dated Jul. 11, 2017 (7 pages) [no English translation].

TW office action in corresponding TW application No. 103128457 dated May 25, 2016 (4 pages).

TW search report in corresponding TW application No. 103128457 dated May 24, 2016 (3 pages).

TW office action in corresponding TW application No. 103128457 dated Dec. 26, 2016 (3 pages).

TW search report in corresponding TW application No. 103128457 dated Dec. 23, 2016 (3 pages).

CN Office Action in corresponding CN application No. 201410416303.1 dated Jan. 17, 2018 (9 pages) [no English translation).

* cited by examiner

TOPOLOGY AND BANDWIDTH MANAGEMENT FOR IO AND INBOUND AV

CROSS REFERENCE TO RELATED APPLICATIONS

This application claims priority to provisional applications 61/868,682 filed Aug. 22, 2013 and 61/879,253 filed Sep. 18, 2013, both expressly incorporated by reference herein.

BACKGROUND

A DisplayPort link consists of a main link, an auxiliary channel (AUX CH), and a Hot Plug Detect (HPD) signal line.

The main link is a unidirectional, high-bandwidth and low-latency channel used to transport isochronous data streams such as uncompressed video and audio.

The auxiliary channel is a half-duplex bidirectional channel used for link management and device control. The HPD signal also serves as an interrupt request by the sink device.

The current DisplayPort (DP) standard, available from VESA, (v1.2a) only streams audio and/or video out from a source device (e.g., a graphics processing unit (GPU) and its software) to a sink device (e.g., a local flat panel or an external monitor). In the extended DisplayPort specification (v.1.4), input/output (IO) support is limited to touch information transmitted in the form of processed Human Interface Device (HID) packets that can be transported over the auxiliary (AUX) channel.

BRIEF DESCRIPTION OF THE DRAWINGS

Some embodiments are described with respect to the following figures.

DETAILED DESCRIPTION

In accordance with some embodiments, DisplayPort or other display interface topology sink devices can stream audio/visual (AV) content to a source device, or can receive or transmit IO information from/to the source device. This IO information may include raw sensor data for a touch screen, for example. A high bandwidth receive link (referred to as RX Link in this document) exists independently of the main link (ML). The RX Link can be trained independently of the ML.

IO and inbound AV make use of Virtual Channels (VCs) that are established using extensions to DP1.2a topology management primitives. The difference in various types of IO and AV arise essentially from where the VC is established, whether it is dedicated or shared, and the framework for quality of service (QoS).

There are two types of IO data herein: isochronous (also referred to as Isoch) and bulk. The main difference between the two types of IO is with respect to guarantees on timeliness of delivery: there are none with bulk IO.

Current solutions for touch screens only support transmission of processed HID reports over a standard AUX channel. Similarly the non-standard "white paper" proposal for Universal Serial Bus version 2 (USB 2.0) over DP1.2a Fast AUX is a proposal for one particular type of IO over DisplayPort. The Universal Serial Bus (USB) 2.0 "proposal" involves a framework specifically for the purpose of supporting USB 2.0. These solutions do not target support for any other IO type, and also do not target native support in DP for inbound audio and/or video streams.

A more complete or generic native framework supports any kind of IO (Isochronous or Bulk, with QoS or without, Inbound or Outbound, USB or PCIe or other IO buses).—Inbound audio and/or inbound video is treated as an independent capability than IO.

Inbound IO is supported by the ability of a source to read a (large) block of data, optionally at a desired frequency—with first in first out (FIFO) semantics. Once established, the sink may ideally sustain transfer of data at that frequency after the initial configuration. Also for inbound IO, a source can read specific DisplayPort Configuration Data (DPCD) registers where IO data is made available through DPCD registers; these accesses are performed using local or remote AUX transactions.

Outbound IO is supported by a source that can write a (large) block of data, optionally at a desired frequency—with FIFO semantics. In an ideal solution the source sustains transfer of this block of data after the initial configuration. Also, a source can write to specific DPCD registers for outbound IO operations where needed; these accesses are performed using local or remote AUX transactions.

Different types of transactions can include isochronous IO involving delivery at configured intervals and allocated link bandwidth, and Bulk IO involving best effort (in terms of time) delivery and maintains FIFO semantics.

Figure 1:
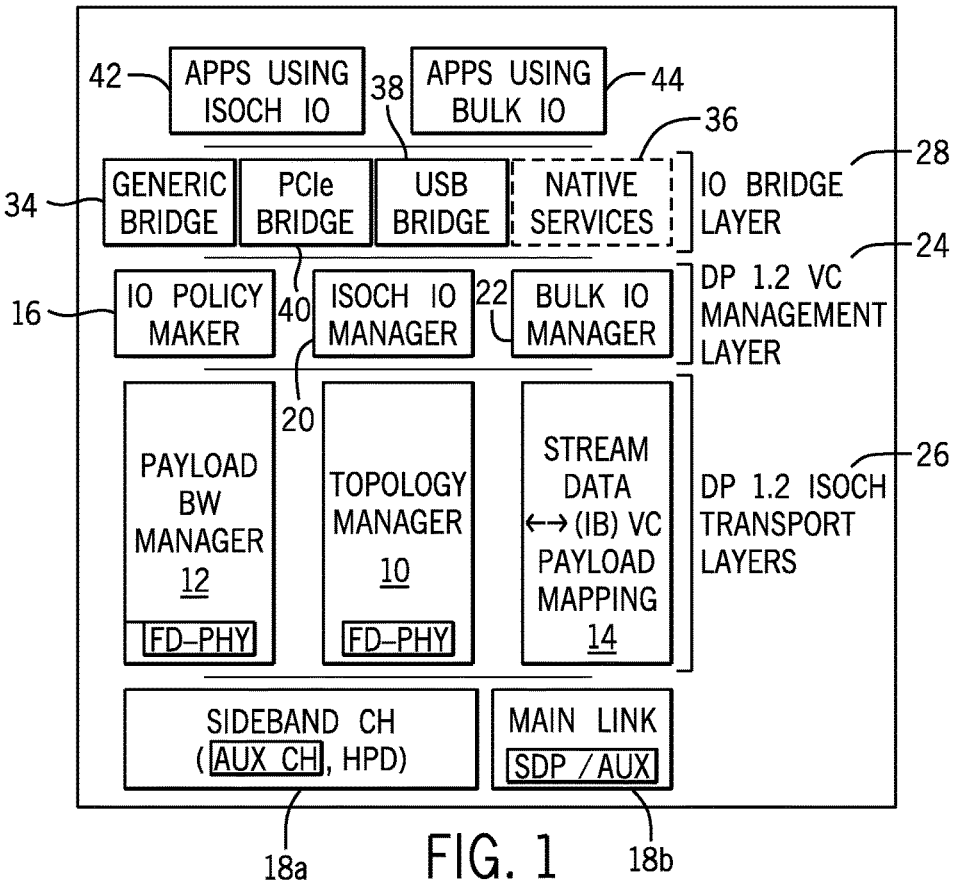
FIG. 1 is a schematic depiction of IO layers in a DP MST device according to one embodiment.

IO and inbound audio/video (AV) functions are available when the Multi-stream transport (MST) link 18, including a sideband channel 18*a* with HPD and an auxiliary channel as well as main link 18*b* having Secondary Data Packets (SDPs), is configured to be in a bi-directional mode of operation. IO layers on a DisplayPort source, branch or sink device are shown in FIG. 1. Topology Management Layer 10 and Payload Bandwidth Management Layer 12 are extended to use message transactions on the bi-directional Main Link for inbound IO and inbound AV. Payload Mapper Layer 14 is an extension of the Stream-to-Virtual Channel mapping block to include virtual channel to stream mapping for inbound AV, virtual channel to data mapping for inbound IO, and data to virtual channel mapping for outbound IO. Topology Management Layer, Payload Bandwidth Management Layer, and the Payload Mapper are part of the DP version 1.2 standard (January 2010) Isochronous Transport Layer 26.

IO Policy Maker 16 resides in parallel to the Stream Policy Maker (18) and is responsible for implementing IO-related policies in the device. It functions in conjunction with Isoch IO Manager 20 and Bulk IO Manager Layers 22 to enable IO capability in the device. Isoch IO Manager is responsible for virtual channel (VC) establishment and management for isoch IO. Similarly, Bulk IO Manager is responsible for VC establishment and management, and data priority management/arbitration. IO Policy Maker, Isoch IO Manager, and Bulk IO Manager are part of the DP1.2 Virtual Channel Management Layer 24. They can use both the services provided by any members of the DP1.2 Isoch Transport Layer 26.

IO Bridge Layer 28 is a client of the DP1.2 VC Management Layer, and contains bridge protocols mapping abstractions made available to IO interfaces such as Universal Serial Bus (USB) or Peripheral Component Interconnect extended (PCIe) onto IO Services exported by the DP 1.2 VC Management Layer. PCIe bridges target specific IO buses. There could also be a Generic IO Bridge 34 that provides a set of abstractions independent of specific IO buses.

IO Services available from the DP1.2 VC Management Layer without the need for any bridging are called the Native IO Services 36. In contrast, certain bridging functions may be needed to map existing IO interfaces such as USB or PCIe onto the functionality defined in the DP specification. These blocks are shown as USB Bridge 38 and PCIe Bridge 40 respectively.

Applications using isochronous IO 42 and/or bulk IO 44 are layered above the IO Policy Maker, and Isoch IO and Bulk IO Managers.

All the links along a given path in a topology are in bi-directional mode before any IO data transfers or inbound AV streaming can be initiated on that path. This switch is initiated by the DP source device on that path.

A DP sink device initiates REQUEST BIDIRECTIONAL MODE Message Transaction to request the DP source on the desired path to initiate a switch to bi-directional mode along that path; it does this when it desires to initiate an IO data transfer.

Devices announce their ability to support bi-directional mode by setting the BIDIRECTIONAL_CAP bit in the MSTM_CAP DisplayPort Configuration Data (DPCD) register.

When a source desires to switch a link to bi-directional mode:

(1) It sets the BIDIRECTIONAL_EN bit in the MSTM_CTRL DPCD register.

(2) Once it receives the Acknowledge (ACK) for the DPCD transaction in Step #1, it initiates a training sequence on the inbound link. The mechanisms and procedure described here can work on a variety of PHY layer implementations so long as they provide bi-directional access at link speeds sufficient to sustain the desired IO and inbound AV transfer rates.

(3) It optionally reads the BIDIRECTIONAL_STATUS bits in SINK_STATUS DPCD register in any downstream device to verify that the transition to Bidirectional mode is complete in that device.

When BIDIRECTIONAL_EN bit is set in a branch device on one of its input ports, it attempts to initiate a similar switch on any BIDIRECTIONAL-PHY capable device detected on its output ports.

A high level sequence of operations for IO data transfer is as follows:

(1) DP source device allocates a VC along the desired path, if needed. The policy for VC allocation is controlled by the IO Policy Maker on the DP Source. The IO Policy Maker can optionally pre-allocate VCs for certain IO operations and not release them until such time as it no longer expects these IO operations to occur.

(2) DP source device configures all the devices along the given path for the upcoming IO operation by using CONFIGURE_IO Message Transaction. VC Payload ID to be used for the upcoming IO operations is one of the parameters in CONFIGURE_IO.

(3) Either the DP source or the DP sink initiates IO data transfer(s) using the configuration received in the previous step.

(4) DP source device releases the VC as per policies set by the IO Policy Maker. At a high level, similar sequences of operations are used for inbound AV streaming also.

Inbound isochronous transfers are used for AV streaming and for isoch IO data transfers from a sink to a source—potentially through a given number of intermediate branch devices.

VC for inbound isochronous transfers is allocated in the inbound path of the bidirectional Main Link using IB_ALLOCATE_PAYLOAD Message Transaction. This Message Transaction fails if any device along the path is not ready in bi-directional mode.

Figure 2:
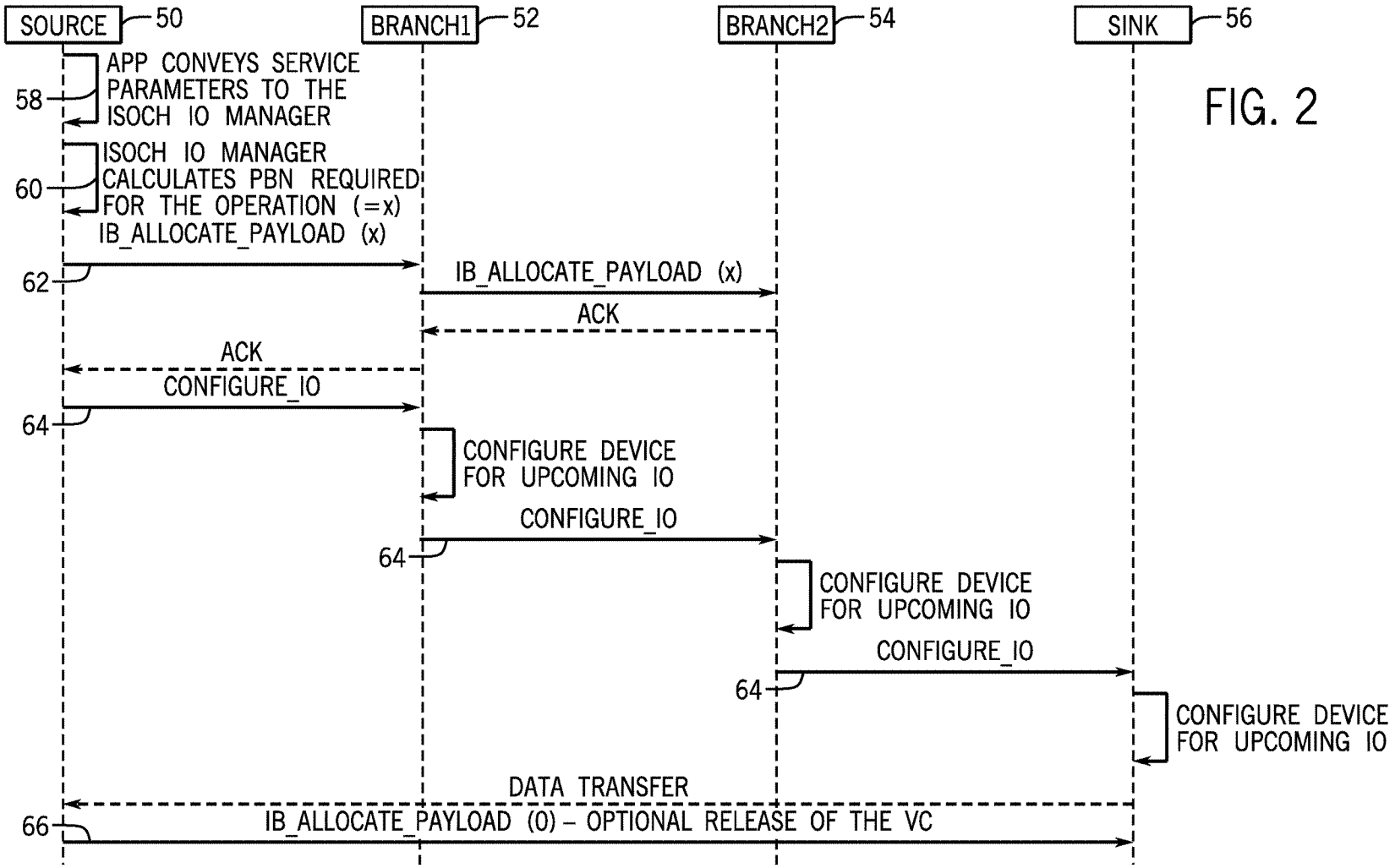
FIG. 2 is a flow chart for an Isoch IO according to one embodiment.

A detailed sequence for inbound isoch IO and inbound AV for one embodiment is shown in FIG. 2. In some embodiments the sequence shown in FIG. 2 may be implemented in software, firmware and/or hardware. In software and firmware embodiments it may be implemented by computer executed instructions stored in one or more non-transitory computer readable media such as magnetic, optical, or semiconductor storages. Separate sequences may be used for each of the source 50, branch 52, 54 and sink 56 devices in some embodiments.

An application on the source 50 conveys 58 the desired service parameters for the upcoming IO to the Isoch IO Manager on the source. This list of parameters includes the sink 56 from which the IO data or AV stream is requested. Alternatively, the application on the sink conveys the desired parameters for the upcoming IO to the Isoch IO Manager on the sink. This list of parameters includes the source targeted for the IO data or AV stream. The Isoch IO Manager on the sink transmits these parameters to the Isoch IO Manager on the source using REQUEST_IB_VC_ALLOCATION Message Transaction.

Isoch IO Manager on the Source calculates the payload bandwidth number (PBN) required 60 for the desired operation using the service parameters it has received.

Isoch IO Manager on the source issues IB_ALLOCATE_PAYLOAD Message Transaction 62 to establish the VC on Inbound main link. Source devices may have no more than one IB_ALLOCATE_PAYLOAD Message Transactions outstanding at any point in time in one embodiment. In the scenario where the sink is directly attached to the source, IB_ALLOCATE_PAYLOAD degenerates into DPCD writes to the IB Payload ID Table on the Sink. IB_ENUM_PATH_RESOURCES, IB_QUERY_PAYLOAD, IB_RESOURCE STATUS NOTIFY, and IB CLEAR PAYLOAD ID TABLE Message Transactions work on main link Inbound in a manner analogous to their counterparts on the main link.

Isoch IO Manager on the source transmits a CONFIGURE_IO Message Transaction 64 to the target sink. Parameters for this CONFIGURE_IO may be as follows in one embodiment:

i. Service_Type: as provided by the application
ii. Transfer_Type: Periodic
iii. Frequency: as provided by the application
iv. IO_Type: Isochronous
v. Direction: Inbound
vi. VC_Payload_ID: VC Payload ID returned by IB_ALLOCATE_PAYLOAD (66)
vii. Service_Specific_Parameters: as provided by the application The Isoch IO Manager on intermediate branch devices and the sink device process CONFIGURE_IO and prepare for the inbound IO or AV operation.

The Isoch IO Manager on the sink initiates transmission of IO data at the desired frequency, or initiates the specified AV stream. In case of IO data, the Isoch IO Manager transmits VC Payload Fill Symbol Sequence when there is no real data to be transmitted.

Upon eventual completion of the IO or AV operation, the Isoch IO Manager on the source transmits STOP_IB_TRANSFER Message Transaction to stop the transfer. STOP_IB_TRANSFER does not cause the VC Payload ID to be released.

Isoch IO Manager on the Source optionally releases the VC using IB_ALLOCATE_PAYLOAD Message Transaction 66. This causes all devices to release the specified VC Payload ID.

Figure 3:
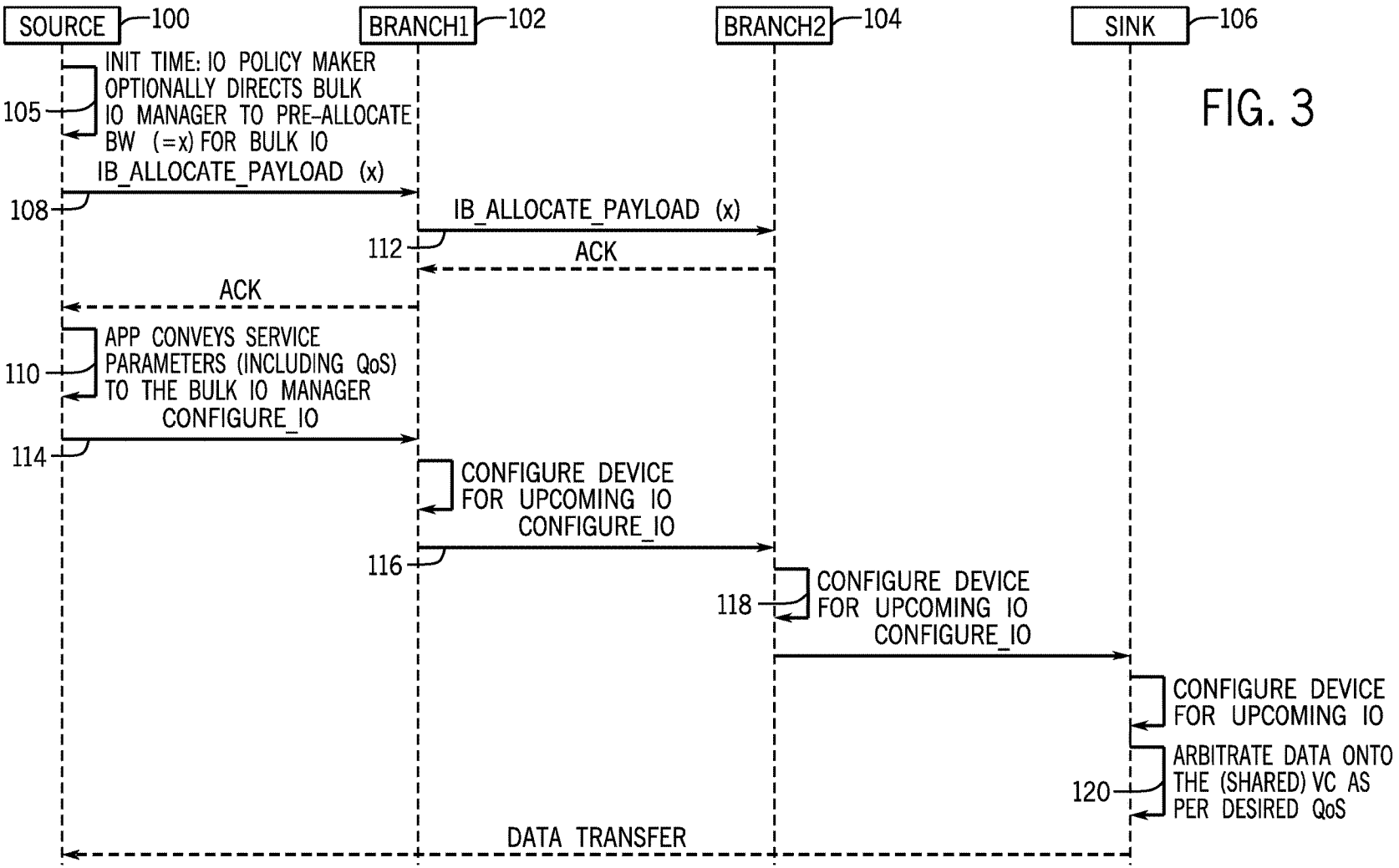
FIG. 3 is a flow chart for an inbound bulk IO according to one embodiment.

Bulk IO data transfers are non-periodic IO transfers scheduled by the Bulk IO Manager based on a parameter, which could be a 3-bit Quality of Service (QoS) field in one embodiment. A detailed sequence for inbound bulk IO according to one embodiment is shown in FIG. 3. In some embodiments the sequence shown in FIG. 3 may be implemented in software, firmware and/or hardware. In software and firmware embodiments it may be implemented by computer executed instructions stored in one or more non-transitory computer readable media such as magnetic, optical, or semiconductor storages. Separate sequences may be used for each of the source, branch and sink devices in some embodiments. The sequence includes the following steps:

(1) The IO Policy Maker on the source 100 optionally directs the Bulk IO Manager to pre-allocate 105 bandwidth on the path (a VC that is shared by all bulk IO transfers) to each Bulk IO-capable sink 108, 112 at source device initialization time. This enables a certain minimum level of bandwidth that can subsequently be enhanced, reduced, or released. Such a pre-allocation reserves bandwidth for bulk IO, and VCs for subsequent isoch IO transfers are allocated around this bandwidth. Without a pre-allocation, dynamic allocation of the (shared) VC for bulk IO would happen around the VCs allocated till that point for isoch IO. For dynamic allocations of VC for bulk IO (if any), the Bulk IO uses IB_ALLOCATE_PAYLOAD Message Transaction (108).

(2) An application on the source conveys 110 the desired parameters for the upcoming IO to the Bulk IO Manager on the source. This list of parameters includes the sink from which the IO data is requested. It also includes the desired 3-bit quality of service (QoS) for this transaction. Alternatively, the application on the sink conveys 114, 116 the desired parameters for the upcoming IO to the Bulk IO Manager on the sink. This list of parameters includes the source to which the IO data is targeted, and the 3-bit QoS. In case a VC for bulk IO transaction has not been established yet, the Bulk IO Manager on the sink transmits the same desired parameters to the Bulk IO Manager on the source using REQUEST_IB_VC_ALLOCATION Message Transaction.

(3) If needed, the Bulk IO Manager on the source calculates the PBN required for the desired operation using the parameters it has received. It then allocates a VC for bulk IO using IB_ALLOCATE_PAYLOAD Message Transaction 112, as described in Step (1) above.

(4) The Bulk IO Manager on the source transmits a CONFIGURE_IO Message Transaction 114, 116 to the target sink Parameters for this CONFIGURE_IO may be as follows in one embodiment:

i. Service_Type: as provided by the application
ii. Transfer_Type: One-Shot
iii. Priority: 3-bit QoS provided by the application
iv. IO_Type: Bulk
v. Direction: Inbound or Outbound, as desired by the application
vi. VC_Payload_ID: the VC to be used for this bulk IO transfer
vii. Service_Specific_Parameters: as provided by the application In case the VC allocation was in response to a prior REQUEST_IB_VC_ALLOCATION, the source executes this step even in the case of a failure in VC allocation. The VC Payload ID communicated back to the sink is INVALID_VC_PAYLOAD_ID, which causes the sink and intermediate branch devices to ignore rest of the parameters in this Message Transaction.

(5) The Bulk IO Manager on intermediate branch devices 102, 104 and the sink device 106 process CONFIGURE_IO 116 and prepare for the inbound IO or AV operation 118.

(6) The Bulk IO Manager on the IO data-originator (source or sink) schedules 120 transfer of the IO data as per the 3-bit QoS.

Sequences for outbound isoch and bulk IO are similar to the corresponding sequences for inbound IO. Key differences are as follows in one embodiment:

Isoch or Bulk IO Manager on the source allocates VC (as needed) for outbound IO transfers on the main link using ALLOCATE_PAYLOAD Message Transaction.

Isoch or Bulk IO Manager on the source transmits CONFIGURE_IO Message Transaction after allocating VC, as done for inbound IO. Based on this the downstream devices monitor the VC for IO data from the source and propagate it downstream.

In case of outbound bulk IO, the Bulk IO Manager on the source schedules data from the applications for transmission based on their 3-bit QoS fields. Bulk IO Managers in the downstream devices process the received IO data in First Come First Served order.

In case of outbound isochronous IO, the Isoch IO Manager on the source initiates IO transfer as per frequency specified by the Application.

IB_ENUM_PATH_RESOURCES is a path resource Message Transaction used to determine the minimum available PBN on the inbound path of the bi-directional Main Link. Syntax for this Message Transaction's Request and Ack_Reply are identical to the syntax for its outbound equivalent (ENUM_PATH_RESOURCES) already defined in the Display Port Spec v1.2a. A device in the path will fail this request if it is not already in bi-directional mode when it receives this message.

IB_ALLOCATE_PAYLOAD is a path or node request Message Transaction that allows a change of the payload allocation for a virtual channel between DP source and sink device on inbound path of bidirectional link. IB_ALLOCATE_PAYLOAD request is used to allocate payload for a new virtual channel, change the payload allocation of an existing virtual channel, or deletion of the payload allocation of an existing virtual channel. Syntax for this Message Transaction's Request and Ack_Reply are identical to the syntax for ALLOCATE_PAYLOAD, which is already defined in DP Standard v1.2a. A device in the path will fail this request if it is not already in bi-directional mode when it receives this message. Devices maintain an IB_VC Payload ID Table to track IB_VC allocations on the inbound path of bidirectional link.

IB_QUERY_PAYLOAD Message Transaction determines the available PBN for the Virtual Channel on the specified by the IB_VC Payload ID parameter. Syntax for this Message Transaction's Request and Ack_Reply are identical to the syntax for QUERY_PAYLOAD, which is already defined in DP Standard v1.2a. A device in the path will fail this request if it is not already in Bidirectional mode when it receives this message.

IB_RESOURCE_STATUS_NOTIFY is a node broadcast Message Transaction, whose functionality and syntax for Request and Ack_Reply parallel those for RESOURCE_STATUS_NOTIFY, which is already defined in DP Standard v1.2a. A difference is that this Message Transaction is used for bandwidth events on the bi-directional mode Inbound path.

After receiving this message, the DP Source can use IB_QUERY_PAYLOAD request to determine which streams are still allocated and which were de-allocated in response to the bandwidth events.

The IB_CLEAR_PAYLOAD_ID_TABLE path broadcast Message Transaction is sent by an MST DP device in bidirectional mode to de-allocate all IB VC Payload IDs allocated to the port the message is received from. As in the case of CLEAR_PAYLOAD_ID_TABLE, this message is only sent to those downstream ports with IB_VC Payloads allocated from the input port being cleared. Syntax for this Message Transaction's Request and Ack_Reply are identical to those for CLEAR_PAYLOAD_ID_TABLE, as already defined in DP Standard v1.2a.

CONFIGURE_IO path Message Transaction is sent by a DP Source to the Sink Device to configure devices along the path with parameters that will be used in the upcoming IO transfer. A device in the path will fail this request if it is not already in bi-directional mode when it receives this message.

A source initiates STOP_IB_TRANSFER Path Message Transaction to stop an isochronous, periodic, inbound IO or AV transfer it had initiated in the past. The specific inbound transfer to be stopped is identified by the VC Payload ID that is included as a parameter in this Message Transaction. The Message Transaction is propagated all the way to the destination node, with intermediate devices updating their state tables before propagating the ACK_Reply back to the Source. A device in the path will fail this request if it is not already in bi-directional mode with the VC Payload ID already being in use for an inbound, isochronous, and periodic IO transfer.

The syntax for STOP_IB_TRANSFER Request is exactly the same as for CONFIGURE_IO_Request, which is already defined in DP Standard v1.2a. The difference is that the parameters are being proposed by the sink for the upcoming transfer. Importantly, the VC_Payload_ID parameter is set to zero by the sink and is not to be interpreted by the Source.

A sink initiates REQUEST_IB_VC_ALLOCATION node Message Transaction to request the source to allocate a VC for a sink-initiated inbound transfer. The transfer could be for isochronous IO, bulk IO, or for inbound AV. The sink communicates all the parameters for this proposed transfer to the source. The source determines the PBN required based on these parameters and initiates allocation of appropriate IB_VC (as needed) and notifies all devices along the path (including the Sink) about the VC and parameters to be used for the upcoming inbound transfer. The Sink should already be in bi-directional mode when it initiates a REQUEST_IB_VC_ALLOCATION.

IO devices and their capabilities may be discovered when they are plugged into downstream DP devices using LINK_ADDRESS:

Input_Port

When set to a one the port information is for a uPacket RX. Otherwise port information is for uPacket TX.

IO_Port

When set to a one, the port is for an IO device. Else, it is for an AV device.

IB_Audio_Capable

When set to a one, the port is capable of inbound Audio.

IB Video_Capable

When set to a one, the port is capable of inbound Video.

Number_SDP_Stream_Sinks

The Number_SDP_Stream_Sinks reports the number of SDP stream sinks associated with the DP Port. This number is valid if the DisplayPort_Device_Plug_Status is set to one.

IB_Isoch_IO_Capable

When set to a one, the device on this port is capable of inbound Isoch IO. This number is valid if the DisplayPort_Device_Plug_Status is set to one.

OB_Isoch_IO_Capable

When set to a one, the device on this port is capable of outbound Isoch IO. This number is valid if the DisplayPort_Device_Plug_Status is set to one.

IB_Bulk_IO

When set to a one, the device on this port is capable of inbound Bulk IO. This number is valid if the DisplayPort_Device_Plug_Status is set to one.

OB_Isoch_IO_Capable

When set to a one, the device is on this port is capable of outbound Bulk IO. This number is valid if the DisplayPort_Device_Plug_Status is set to one.

Native_IO_Services_Capability

This is a bit-field indicating Native IO Service capability of the device at this port. Encoding of this bit-field follows the definition of DPCD register 62001h. This number is valid if the DisplayPort_Device_Plug_Status is set to one.

Bridged_IO_Services_Capability

When set to a one, the port is capable of outbound Bulk IO. Encoding of this bit-field follows the definition of DPCD register 62002h. This number is valid if the DisplayPort_Device_Plug_Status is set to one.

Figure 4:
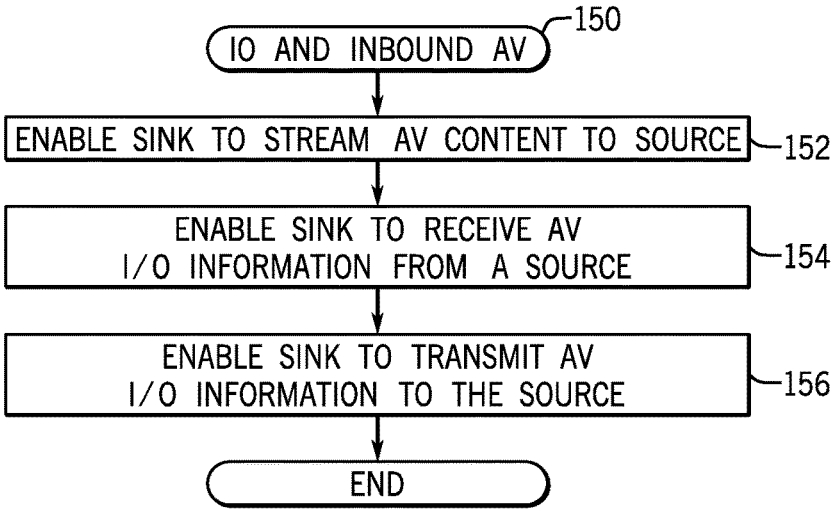
FIG. 4 is a flow chart for another embodiment.

Referring to FIG. 4, a sequence for implementing IO and inbound AV in a source device in accordance with some embodiments may be implemented in software, firmware and/or hardware. In software and firmware embodiments it may be implemented by computer executed instructions stored in one or more non-transitory computer readable media such as a magnetic, optical or semiconductor storage.

The sequence 150 begins by enabling the sink to stream AV content of the sources indicated in block 152. Then the sink is enabled to receive AV information from the source as indicated in block 154. Next the sink is enabled to transport AV IO information to the source as indicated in block 156.

Figure 5:
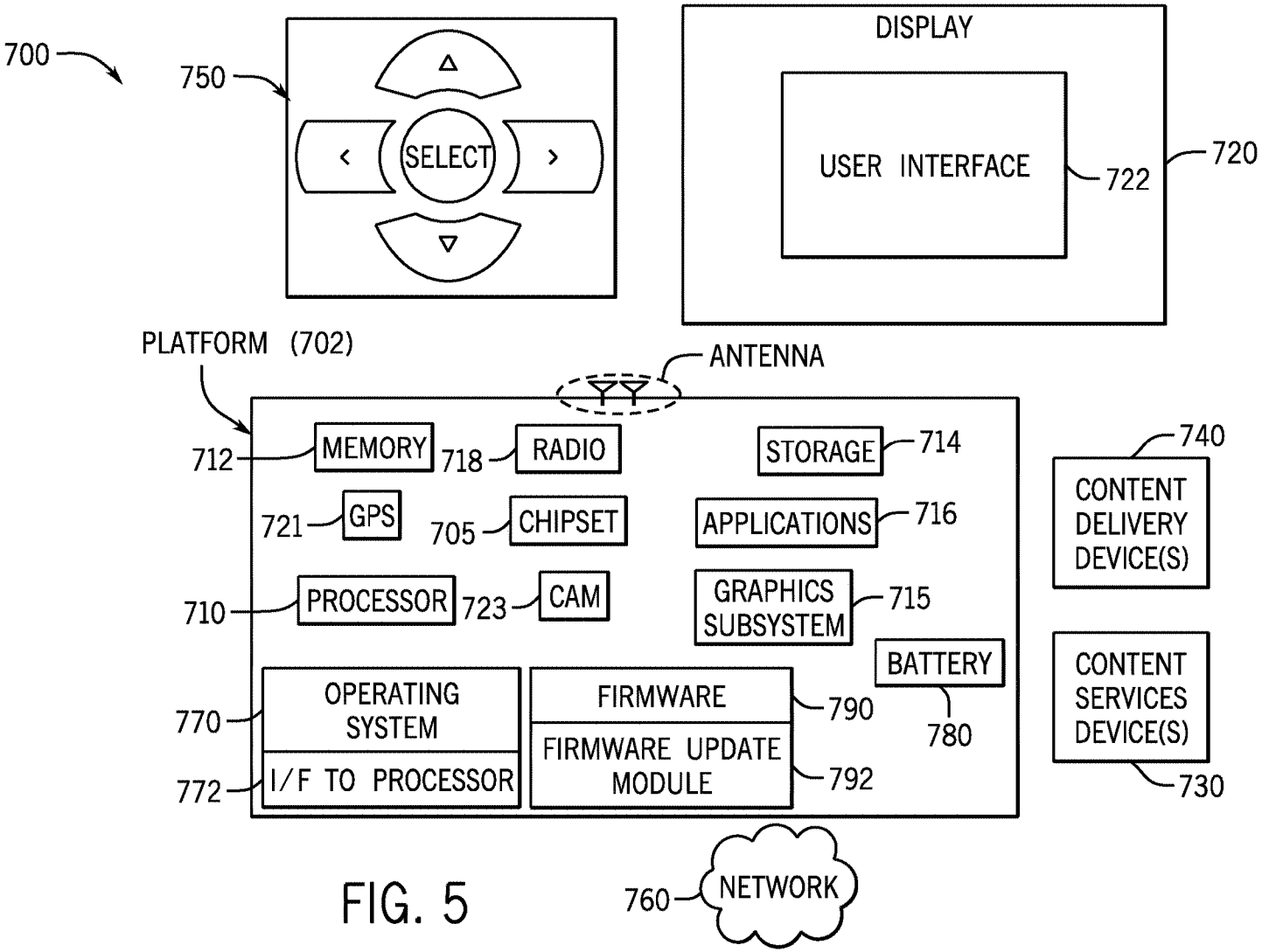
FIG. 5 is a system depiction for one embodiment.

FIG. 5 illustrates an embodiment of a system 700. In embodiments, system 700 may be a media system although system 700 is not limited to this context. For example, system 700 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

In embodiments, system 700 comprises a platform 702 coupled to a display 720. Platform 702 may receive content from a content device such as content services device(s) 730 or content delivery device(s) 740 or other similar content sources. A navigation controller 750 comprising one or more navigation features may be used to interact with, for example, platform 702 and/or display 720. Each of these components is described in more detail below.

In embodiments, platform 702 may comprise any combination of a chipset 705, processor 710, memory 712, storage 714, graphics subsystem 715, applications 716 and/or radio 718. Chipset 705 may provide intercommunication among processor 710, memory 712, storage 714, graphics subsystem 715, applications 716 and/or radio 718. For example, chipset 705 may include a storage adapter (not depicted) capable of providing intercommunication with storage 714.

Processor 710 may be implemented as Complex Instruction Set Computer (CISC) or Reduced Instruction Set Computer (RISC) processors, x86 instruction set compatible processors, multi-core, or any other microprocessor or central processing unit (CPU). In embodiments, processor 710 may comprise dual-core processor(s), dual-core mobile processor(s), and so forth. The processor may implement the sequence of FIG. 8 together with memory 712.

Memory 712 may be implemented as a volatile memory device such as, but not limited to, a Random Access Memory (RAM), Dynamic Random Access Memory (DRAM), or Static RAM (SRAM).

Storage 714 may be implemented as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In embodiments, storage 714 may comprise technology to increase the storage performance enhanced protection for valuable digital media when multiple hard drives are included, for example.

Graphics subsystem 715 may perform processing of images such as still or video for display. Graphics subsystem 715 may be a graphics processing unit (GPU) or a visual processing unit (VPU), for example. An analog or digital interface may be used to communicatively couple graphics subsystem 715 and display 720. For example, the interface may be any of a High-Definition Multimedia Interface, DisplayPort, wireless HDMI, and/or wireless HD compliant techniques. Graphics subsystem 715 could be integrated into processor 710 or chipset 705. Graphics subsystem 715 could be a stand-alone card communicatively coupled to chipset 705.

The graphics and/or video processing techniques described herein may be implemented in various hardware architectures. For example, graphics and/or video functionality may be integrated within a chipset. Alternatively, a discrete graphics and/or video processor may be used. As still another embodiment, the graphics and/or video functions may be implemented by a general purpose processor, including a multi-core processor. In a further embodiment, the functions may be implemented in a consumer electronics device.

Radio 718 may include one or more radios capable of transmitting and receiving signals using various suitable wireless communications techniques. Such techniques may involve communications across one or more wireless networks. Exemplary wireless networks include (but are not limited to) wireless local area networks (WLANs), wireless personal area networks (WPANs), wireless metropolitan area network (WMANs), cellular networks, and satellite networks. In communicating across such networks, radio 718 may operate in accordance with one or more applicable standards in any version.

In embodiments, display 720 may comprise any television type monitor or display. Display 720 may comprise, for example, a computer display screen, touch screen display, video monitor, television-like device, and/or a television. Display 720 may be digital and/or analog. In embodiments, display 720 may be a holographic display. Also, display 720 may be a transparent surface that may receive a visual projection. Such projections may convey various forms of information, images, and/or objects. For example, such projections may be a visual overlay for a mobile augmented reality (MAR) application. Under the control of one or more software applications 716, platform 702 may display user interface 722 on display 720.

In embodiments, content services device(s) 730 may be hosted by any national, international and/or independent service and thus accessible to platform 702 via the Internet, for example. Content services device(s) 730 may be coupled to platform 702 and/or to display 720. Platform 702 and/or content services device(s) 730 may be coupled to a network 760 to communicate (e.g., send and/or receive) media information to and from network 760. Content delivery device(s) 740 also may be coupled to platform 702 and/or to display 720.

In embodiments, content services device(s) 730 may comprise a cable television box, personal computer, network, telephone, Internet enabled devices or appliance capable of delivering digital information and/or content, and any other similar device capable of unidirectionally or bidirectionally communicating content between content providers and platform 702 and/display 720, via network 760 or directly. It will be appreciated that the content may be communicated unidirectionally and/or bidirectionally to and from any one of the components in system 700 and a content provider via network 760. Examples of content may include any media information including, for example, video, music, medical and gaming information, and so forth.

Content services device(s) 730 receives content such as cable television programming including media information, digital information, and/or other content. Examples of content providers may include any cable or satellite television or radio or Internet content providers. The provided examples are not meant to limit the applicable embodiments.

In embodiments, platform 702 may receive control signals from navigation controller 750 having one or more navigation features. The navigation features of controller 750 may be used to interact with user interface 722, for example. In embodiments, navigation controller 750 may be a pointing device that may be a computer hardware component (specifically human interface device) that allows a user to input spatial (e.g., continuous and multi-dimensional) data into a computer. Many systems such as graphical user interfaces (GUI), and televisions and monitors allow the user to control and provide data to the computer or television using physical gestures.

Movements of the navigation features of controller 750 may be echoed on a display (e.g., display 720) by movements of a pointer, cursor, focus ring, or other visual indicators displayed on the display. For example, under the control of software applications 716, the navigation features located on navigation controller 750 may be mapped to virtual navigation features displayed on user interface 722, for example. In embodiments, controller 750 may not be a separate component but integrated into platform 702 and/or display 720. Embodiments, however, are not limited to the elements or in the context shown or described herein.

In embodiments, drivers (not shown) may comprise technology to enable users to instantly turn on and off platform 702 like a television with the touch of a button after initial boot-up, when enabled, for example. Program logic may allow platform 702 to stream content to media adaptors or other content services device(s) 730 or content delivery device(s) 740 when the platform is turned "off." In addition, chip set 705 may comprise hardware and/or software support for 5.1 surround sound audio and/or high definition 7.1 surround sound audio, for example. Drivers may include a graphics driver for integrated graphics platforms. In embodiments, the graphics driver may comprise a peripheral component interconnect (PCI) Express graphics card.

In various embodiments, any one or more of the components shown in system 700 may be integrated. For example, platform 702 and content services device(s) 730 may be integrated, or platform 702 and content delivery device(s) 740 may be integrated, or platform 702, content services device(s) 730, and content delivery device(s) 740 may be integrated, for example. In various embodiments, platform 702 and display 720 may be an integrated unit. Display 720 and content service device(s) 730 may be integrated, or display 720 and content delivery device(s) 740 may be integrated, for example. These examples are not meant to be scope limiting.

In various embodiments, system 700 may be implemented as a wireless system, a wired system, or a combination of both. When implemented as a wireless system, system 700 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 700 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Platform 702 may establish one or more logical or physical channels to communicate information. The information may include media information and control information. Media information may refer to any data representing content meant for a user. Examples of content may include, for example, data from a voice conversation, videoconference, streaming video, electronic mail ("email") message, voice mail message, alphanumeric symbols, graphics, image, video, text and so forth. Data from a voice conversation may be, for example, speech information, silence periods, background noise, comfort noise, tones and so forth. Control information may refer to any data representing commands, instructions or control words meant for an automated system. For example, control information may be used to route media information through a system, or instruct a node to process the media information in a predetermined manner. The embodiments, however, are not limited to the elements or in the context shown or described in FIG. 5.

Figure 6:
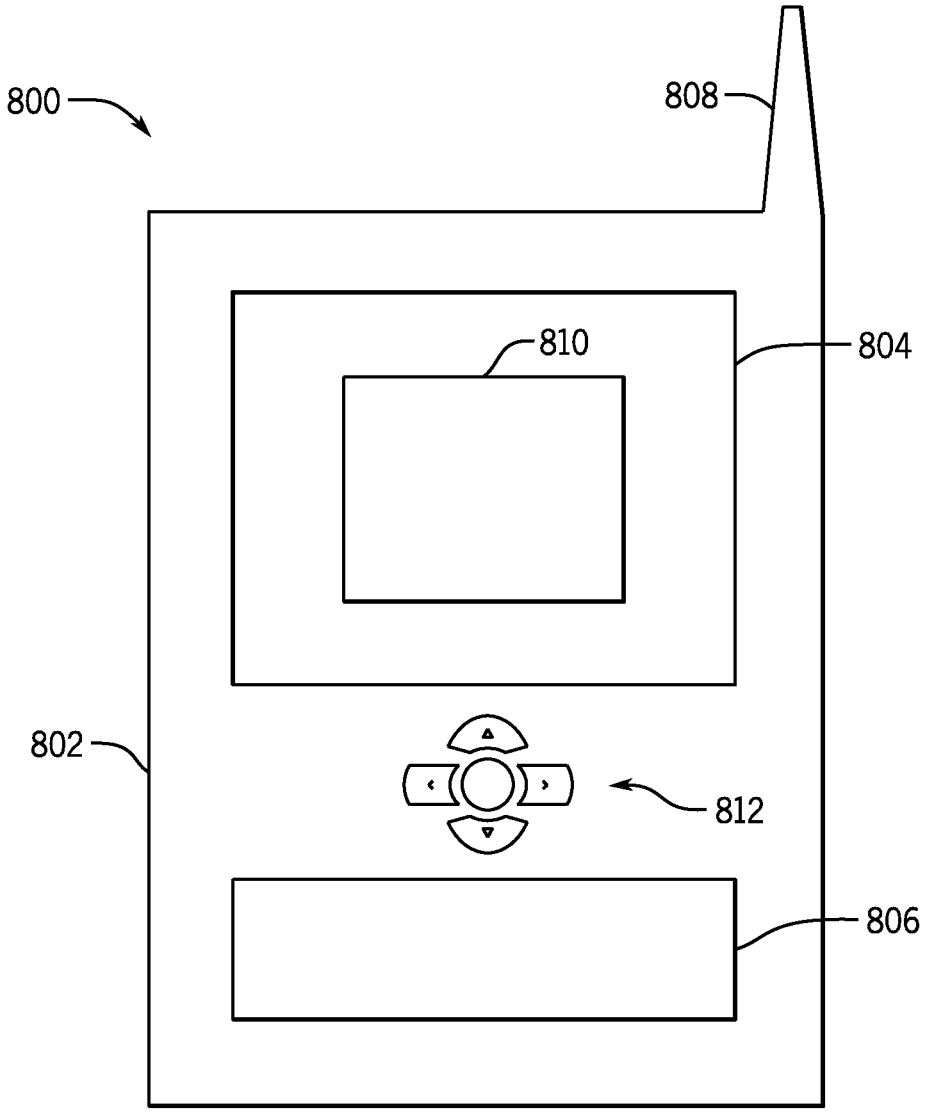
FIG. 6 is a front elevational view of one embodiment

As described above, system 700 may be embodied in varying physical styles or form factors. FIG. 6 illustrates embodiments of a small form factor device 800 in which system 700 may be embodied. In embodiments, for example, device 800 may be implemented as a mobile computing device having wireless capabilities. A mobile computing device may refer to any device having a processing system and a mobile power source or supply, such as one or more batteries, for example.

As described above, examples of a mobile computing device may include a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

Examples of a mobile computing device also may include computers that are arranged to be worn by a person, such as a wrist computer, finger computer, ring computer, eyeglass computer, belt-clip computer, arm-band computer, shoe computers, clothing computers, and other wearable computers. In embodiments, for example, a mobile computing device may be implemented as a smart phone capable of executing computer applications, as well as voice communications and/or data communications. Although some embodiments may be described with a mobile computing device implemented as a smart phone by way of example, it may be appreciated that other embodiments may be implemented using other wireless mobile computing devices as well. The embodiments are not limited in this context.

The following clauses and/or examples pertain to further embodiments:

One example embodiment may be a method comprising enabling a sink device to stream audio/visual content to a source device over a display interface, and enabling the sink device to receive audio/visual and/or input/output information from a source device and to transmit audio and/or video and/or input/output information to a source device over the display interface. The method may also include wherein the input/output information includes raw touch screen sensor data. The method may also include providing a main link and an independent receive link. The method may also include implementing a DisplayPort topology that includes audio/visual and input/output devices. The method may also include supporting both isochronous and bulk input/output transfers and inbound audio and/or video. The method may also include enabling multiple concurrent input/output operations. The method may also include enabling prioritization of bulk I/O from applications on a device originating a request. The method may also include enabling entities to prioritize among concurrent isoch I/O applications on an originating device. The method may also include enabling discovery of input/output devices and their capabilities when they are plugged into downstream devices and thereby applying an address generation mechanism for a DisplayPort interface for input/output devices. The method may also include enabling the source to read a block of data with first in first out semantics. The method may also include enabling the source to read DisplayPort configuration data registers for inbound and outbound input/output information. The method may also include a sink to request a source to initiate a switch to enable an input/output data transfer from sink to source. The method may also include enabling the source to configure all devices along the path for the input/out data transfer.

Another example embodiment may be one or more non-transitory computer readable media storing instructions executed by a processor to perform a sequence comprising enabling a sink device to stream audio/visual content to a source device, and enabling the sink device to receive audio/visual input/output information from a source device and to transmit audio/video input/output information to a source device. The media wherein the input/output information includes raw touch screen sensor data. The media may include said sequence including providing a main link and an independent receive link. The media may include said sequence including implementing a DisplayPort topology. The media may include said sequence including supporting both isochronous and bulk transfers and inbound audio and video. The media may include said sequence including enabling the source to read a block of data with first in first out semantics. The media may include said sequence including enabling the source to read DisplayPort configuration data registers for inbound and outbound input/output information. The media may include said sequence including a sink to request a source to initiate a switch to enable an input/output data transfer from sink to source. The media may include said sequence including enabling the source to configure all devices along the path for the input/out data transfer.

In another example embodiment may be a sink comprising a processor to stream audio/visual content to a source device, to receive audio/visual input/output information from a source device and to transmit audio/video input/output information to a source device, and a memory coupled to said processor. The sink wherein the input/output information includes raw touch screen sensor data. The sink of said processor to provide a main link and an independent receive link. The sink of said processor to implement a DisplayPort topology. The sink of said processor to support both isochronous and bulk transfers and inbound audio and video. The sink of said processor to request a source to initiate a switch to enable an input/output data transfer from sink to source. The sink may include a display communicatively coupled to the processor. The sink may include a battery coupled to the processor.

References throughout this specification to "one embodiment" or "an embodiment" mean that a particular feature, structure, or characteristic described in connection with the embodiment is included in at least one implementation encompassed within the present disclosure. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While a limited number of embodiments have been described, those skilled in the art will appreciate numerous modifications and variations therefrom. It is intended that the appended claims cover all such modifications and variations as fall within the true spirit and scope of this disclosure.

What is claimed is:

1. A method comprising:

enabling a sink device to stream audio/visual content to a source device over a bidirectional line of a display interface; and enabling the sink device to receive audio/visual and input/output information from a source device, and to transmit audio, video and input/output information to a source device over the display interface bidirectional line.

2. The method of claim 1 wherein the input/output information includes raw touch screen sensor data.

3. The method of claim 1 including providing a main link and an independent receive link.

4. The method of claim 1 including implementing a DisplayPort topology that includes audio/visual and input/output devices.

5. The method of claim 1 including supporting both isochronous and bulk input/output transfers and inbound audio and/or video.

6. The method of claim 5 including enabling multiple concurrent input/output operations.

7. The method of claim 5 including enabling prioritization of bulk I/O from applications on a device originating a request.

8. The method of claim 5 including enabling entities to prioritize among concurrent isoch I/O applications on an originating device.

9. The method of claim 5 including enabling discovery of input/output devices and their capabilities when they are plugged into downstream devices and thereby applying an address generation mechanism for a DisplayPort interface for input/output devices.

10. The method of claim 1 including enabling the source to read a block of data with first in first out semantics.

11. The method of claim 1 including enabling the source to read DisplayPort configuration data registers for inbound and outbound input/output information.

12. The method of claim 1 including a sink to request a source to initiate a switch to enable an input/output data transfer from sink to source.

13. The method of claim 12 including enabling the source to configure all devices along the path for the input/out data transfer.

14. One or more non-transitory computer readable media storing instructions executed by a processor to perform a sequence comprising:

enabling a sink device to stream audio/visual content to a source device over a bidirectional line of a display interface; and enabling the sink device to receive audio/visual, and input/output information from a source device and to transmit audio or video and input/output information to a source device over the display interface bidirectional line.

15. The media of claim 14 wherein the input/output information includes raw touch screen sensor data.

16. The media of claim 14 said sequence including providing a main link and an independent receive link.

17. The media of claim 14 said sequence including implementing a DisplayPort topology.

18. The media of claim 14 said sequence including supporting both isochronous and bulk transfers and inbound audio and video.

19. The media of claim 14 said sequence including enabling the source to read a block of data with first in first out semantics.

20. The media of claim 14 said sequence including enabling the source to read DisplayPort configuration data registers for inbound and outbound input/output information.

21. The media of claim 14 said sequence including a sink to request a source to initiate a switch to enable an input/output data transfer from sink to source.

22. The media of claim 21 said sequence including enabling the source to configure all devices along the path for the input/out data transfer.

23. A sink comprising:

a processor to stream audio/visual content to a source device over a bidirectional line of a display interface, to receive audio/visual, and input/output information from a source device and to transmit audio/video and input/output information to a source device over the display interface bidirectional line; and a memory coupled to said processor.

24. The sink of claim 23 wherein the input/output information includes raw touch screen sensor data.

25. The sink of claim 23 said processor to provide a main link and an independent receive link.

26. The sink of claim 23 said processor to implement a DisplayPort topology.

27. The sink of claim 23 said processor to support both isochronous and bulk transfers and inbound audio and video.

28. The sink of claim 23 said processor to request a source to initiate a switch to enable an input/output data transfer from sink to source.

29. The sink of claim 23 including a display communicatively coupled to the processor.

30. The sink of claim 23 including a battery coupled to the processor.

* * * * *